US005088713A

United States Patent [19]

Hayashi

[11] Patent Number: 5,088,713

[45] Date of Patent: Feb. 18, 1992

[54] PAPER REFEEDING DEVICE FOR AN IMAGE FORMING APPARATUS

[75] Inventor: Shoji Hayashi, Yokohama, Japan

[73] Assignee: Ricoh Company, Ltd., Tokyo, Japan

[21] Appl. No.: 505,366

[22] Filed: Apr. 6, 1990

[30] Foreign Application Priority Data

Apr. 7, 1989 [JP] Japan ..... 1-88968

[51] Int. Cl.[5] ..... B65H 3/12

[52] U.S. Cl. ..... 271/3.1; 271/96; 271/98; 271/99; 271/108

[58] Field of Search ..... 271/96, 98, 99, 108, 271/3.1

[56] References Cited

U.S. PATENT DOCUMENTS

| | | | |
|---|---|---|---|
| 4,269,406 | 5/1981 | Hamlin | 271/98 X |
| 4,336,928 | 6/1982 | Smith et al. | 271/98 |
| 4,397,459 | 8/1983 | Silverberg | 271/98 X |
| 4,418,905 | 12/1983 | Garavuso | 271/98 |
| 4,469,320 | 9/1984 | Wenthe | 271/98 |
| 4,543,395 | 10/1985 | Smellman et al. | 271/99 |
| 4,550,903 | 11/1985 | Moore | 271/98 |
| 4,566,683 | 1/1986 | Moore | 271/98 |
| 4,589,645 | 5/1986 | Tracy | 271/98 X |
| 4,597,570 | 7/1986 | Huggins | 271/98 |
| 4,728,091 | 3/1988 | Couwenberg | 271/97 |
| 4,824,091 | 4/1989 | Knight | 271/207 |
| 4,869,488 | 9/1989 | Hiruta et al. | 271/3.1 |

FOREIGN PATENT DOCUMENTS

| | | | |
|---|---|---|---|
| 291339 | 12/1986 | Japan | 271/99 |
| 202534 | 8/1988 | Japan | 271/98 |
| 2126996 | 4/1984 | United Kingdom | 271/99 |

*Primary Examiner*—Richard A. Schacher

*Attorney, Agent, or Firm*—Oblon, Spivak, McClelland, Maier & Neustadt

[57] ABSTRACT

A paper refeeding device incorporated in an image forming apparatus for temporarily stacking paper sheets each coming out of an image forming section and carrying an image on one side on a refeed tray and, then, refeeding the paper sheets to the image forming section. An air velocity switching mechanism causes an air knife to blow air at a breeze velocity or a zero velocity which does not lift the paper sheets stacked on the refeed tray, until more than a predetermined number of paper sheets have been discharged by discharge rollers and stacked on the refeed tray.

9 Claims, 9 Drawing Sheets

PAPER REFEEDING DEVICE FOR AN IMAGE FORMING APPARATUS

BACKGROUND OF THE INVENTION

The present invention relates to a paper refeeding device incorporated in a copier, printer or similar image forming apparatus for temporarily stacking paper sheets each coming out of an image forming section and carrying an image on one side thereof on a refeed tray and, then, refeeding the paper sheets to the image forming section.

A paper feeding device for use in a copier, printer or similar image forming apparatus may be implemented by an air knife and sucking means, as disclosed in Japanese Patent Laid-Open Publication No. 56-56442, for example. Specifically, an air knife blows air against one end of a stack of paper sheets loaded on a tray so as to lift the paper sheets, while sucking means urges the lowermost paper sheet on the tray against transporting means by suction to separate it from the others. The paper sheets held in such a condition are sequentially fed out from the tray, the lowermost one being first. This type of paper feeding device is attracting much attention because it achieves more rapid paper feed than a paper feeding device of the type using a pick-up roller which has to be moved up and down every time a paper sheet is fed. The paper feeding device using an air knife selects the highest air velocity when a great number of paper sheets exist on the tray, while reducing the air velocity stepwise as the number of paper sheets decreases. Even when only a small number of paper sheets remain on the tray, the air knife of the prior art device constantly blows air at a velocity high enough to lift the paper sheets overlying the lowermost paper sheet away from the latter.

Assume that the air knife type paper feeding device is implemented as a paper refeeding device incorporated in a copier for executing two-sided copy mode and combination copy mode operations. Then, the air knife constantly blows air against the end of the paper stack on a refeed tray at a velocity high enough to lift the paper sheets. Hence, if the number of paper sheets is less than ten, for example, and the intermediate portion of the paper sheets is curled upward away from the tray or the paper sheets are bent due to low elasticity, the air blowing against the end of the paper stack aggravates the curl. When the transporting means transports the paper sheet in the above condition by a predetermined distance in a predetermined direction and then brings it to a halt, the edge of the paper sheet will be located at a position deviated from an expected position where the edge would be located if the the curl were not aggravated. Further, assume that all the paper sheets for producing copies are stacked on the tray and then refed one by one. In this case, air is also constantly blown against the end of the paper stack at a velocity high enough to lift the latter. Since the weight of the entire stack sequentially decreases with the number of paper sheets on the tray, the stack bodily waves up and down and thereby increases the period of time necessary for the lowermost paper sheet to be urged against the transporting means by the suction exerted by the sucking means.

When an attempt is made to enhance rapid paper transport by reducing the interval at which the transporting means transports the paper sheets, the transporting means will begin driving the paper sheet before the latter is pressed thereagainst by the suction, again failing to feed out the paper sheet. Thus, the transport speed available with the prior art device is limited despite the use of air.

SUMMARY OF THE INVENTION

It is therefore an object of the present invention to provide a paper refeeding device for an image forming apparatus which surely refeeds even a small number of paper sheets discharged and stacked on a refeed tray to an image forming section of the image forming apparatus.

It is another object of the present invention to provide a paper refeeding device for an image forming apparatus which positively refeeds even a small number of curled paper sheets stacked on a refeed tray toward an image forming section of the image forming apparatus at a refeeding stage.

It is another object of the present invention to provide a generally improved paper refeeding device for an image forming apparatus.

A paper refeeding device incorporated in an image forming apparatus for temporarily stacking paper sheets each coming out of an image forming section and carrying an image on one side on a refeed tray and, then, refeeding the paper sheets to the image forming section of the present invention comprises a discharging member for discharging the paper sheets one by one onto the refeed tray by transporting the paper sheets, an air knife for blowing air against an end portion of the paper sheets discharged by the discharging member onto the refeed tray to lift the paper sheets overlying the lowermost paper sheet away from at least the lowermost paper sheet, a transporting member for refeeding the paper sheets stacked on the refeed tray to the image forming section, a sucking mechanism for urging the lowermost paper sheet on the refeed tray against the transporting member by suction, and an air velocity switching mechanism for causing the air knife to blow air at either one of a breeze velocity and a zero velocity which do not lift the paper sheets, until more than a predetermined number of paper sheets have been discharged by the discharging member and stacked on the refeed tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art paper feeding device, shown in FIG. 1. The paper feeding device of FIG. 1 is of the type shown and described in previously stated Japanese Patent Laid-Open Publication No. 56-56442 and using a stream of air.

Figure 1:
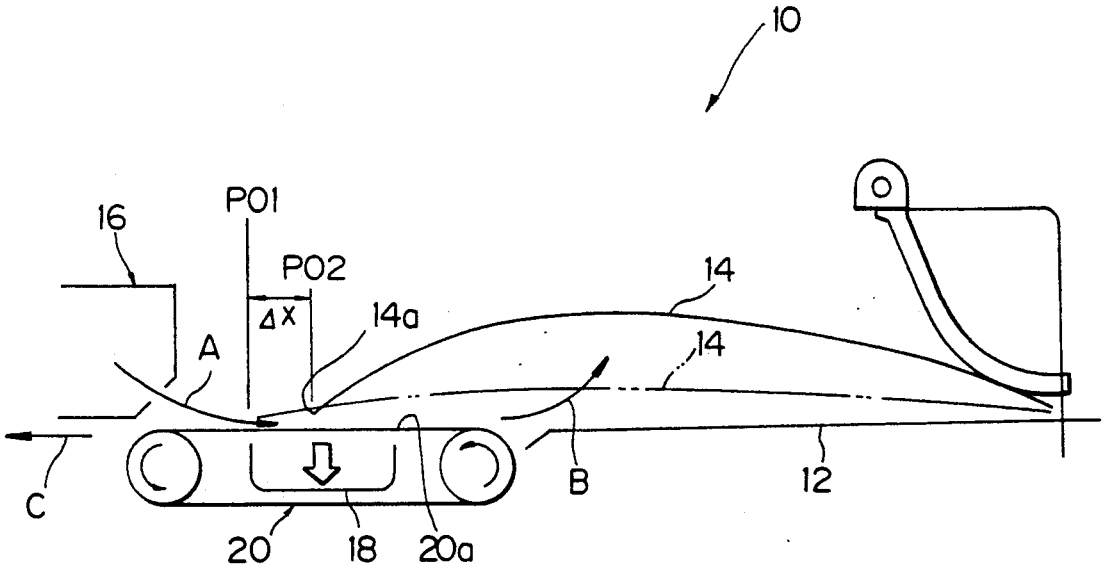
Fig. 1 PRIOR ART
FIG. 1 is view useful for understanding non-feed which occurs in a prior art paper feeding device of the type using air when air for lifting paper sheets is blown out at a stacking stage.

Assume that the paper feeding device of FIG. 1 is implemented as a paper refeeding device incorporated in a copier for executing two-sided copy mode and combination copy mode operations. The device 10 has a refeed tray 12 which is loaded with a stack of paper sheets 14. An air knife 16 constantly blows air against one end 14*a* of the paper stack 14 at a velocity high enough to lift the paper sheets, as indicated by an arrow A. Hence, if the number of paper sheets 14 is less than ten, for example, and the intermediate portion of the paper sheets 14 is curled upward away from the tray 12, the air blowing against the end 14*a* of the paper stack 14 urges the latter further upward as indicated by an arrow B. As a result, the paper stack 14 is further curled from the position indicated by a phantom line to the position indicated by a solid line. As sucking means 18 begins to suck the curled lowermost paper sheet 14 as indicated by an arrow, the edge 14*a* of the paper sheet 14 is urged against a belt 20*a* of transporting means 20 at a position $PO_2$ which is deviated from an expected position $PO_1$ where the edge 14*a* would be located if the curl of the paper sheet were not aggravated. When the belt 20*a* transports the paper sheet 14 in the above condition by a predetermined distance as indicated by an arrow C and then brings it to a halt, the edge 14*a* will be located at a position short of an expected position by a distance $\Delta X$. Then, it is likely that the device 10 practically fails to feed the paper sheet 14 or to feed it by a sufficient distance. Further, assume that all the paper sheets 14 for producing copies are stacked on the tray 12 and then refed one by one. In this case, air is also constantly blown against the edge 14*a* of the paper sheets 14 at a velocity high enough to lift the latter. As the number of paper sheets 14 sequentially decreases due to refeed, the weight of the entire stack sequentially decreases also. This causes the paper stack to bodily wave up and down and thereby increases the period of time necessary for the lowermost paper sheet 14 to be urged against the belt 20*a* by the suction exerted by the sucking means 18. When an attempt is made to enhance rapid paper transport by reducing the interval at which the transporting means 20 transports the paper sheets 14, the transporting means 20 will begin driving the paper sheet 14 before the latter is pressed thereagainst by the suction, again failing to feed out the paper sheet 14. Thus, the transport speed available with the device 10 is limited despite the use of a stream of air.

Figure 2:
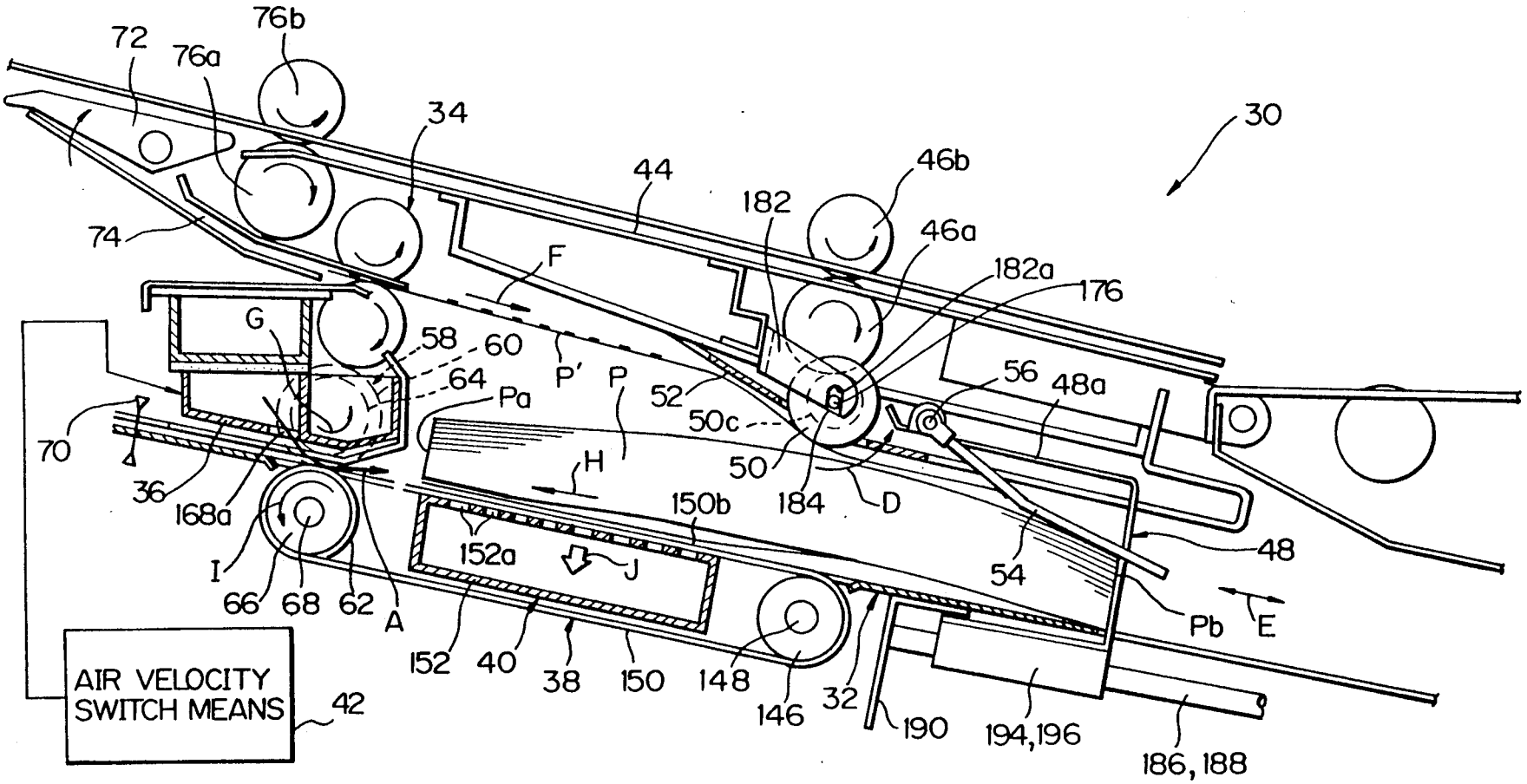
FIG. 2 is a section showing a paper refeeding device embodying the present invention.
Figure 3:
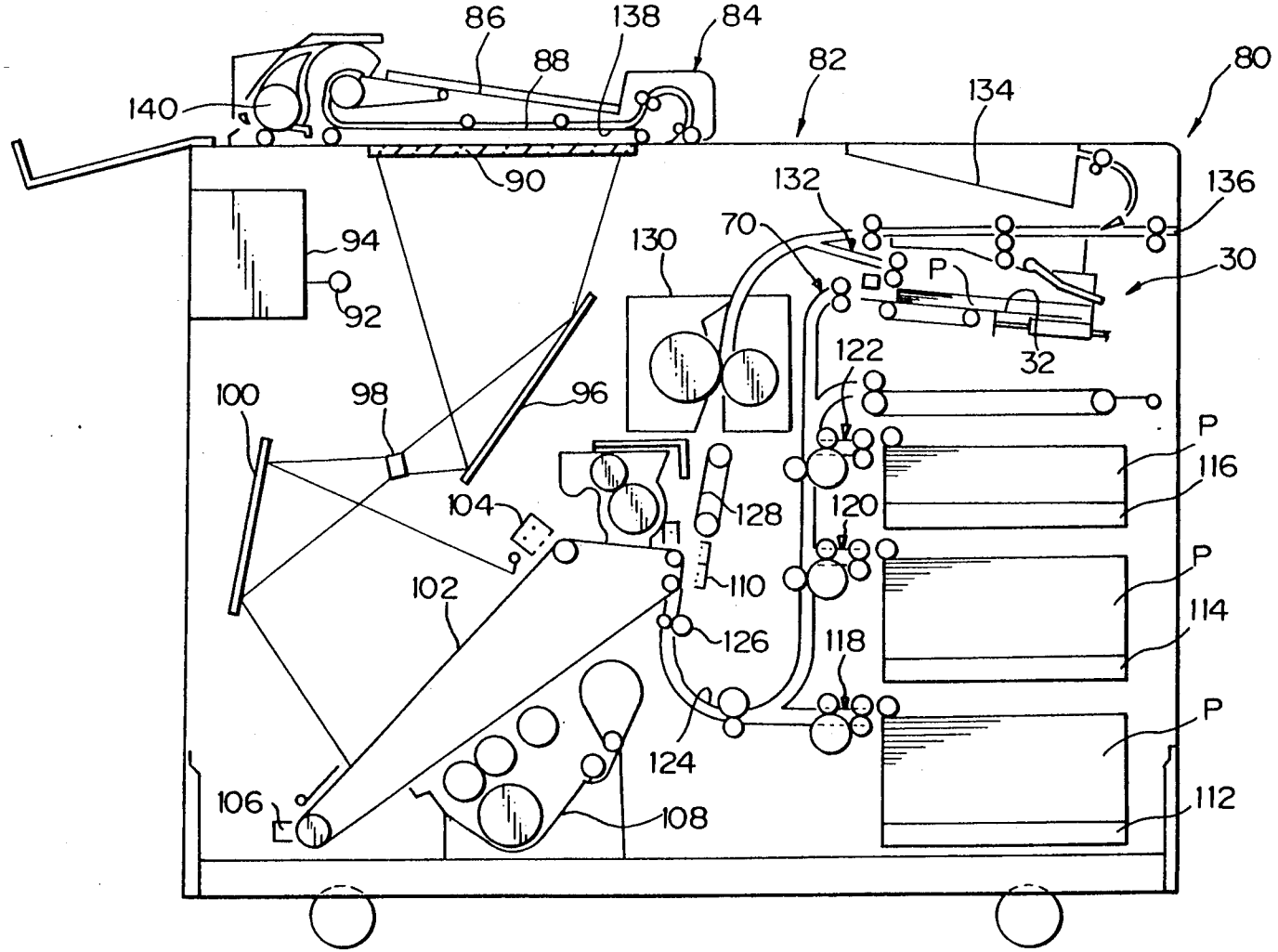
FIG. 3 is a section showing a copier to which the paper refeeding device of FIG. 2 is applied.

Referring to FIGS. 2 and 3, a paper refeeding device embodying the present invention is shown and generally designated by the reference numeral 30. As shown, the device 30 includes a pair of discharge rollers 34 which are rotatable as indicated by arrows in FIG. 2. The discharge rollers 34 drive paper sheets P each carrying an image on one side thereof (upper surface as viewed in the figures) onto a refeed tray 32. An air knife 36 blows air against one end Pa of the paper sheets P which will be the leading end at the time of refeed. The air knife 36, therefore, lifts at least the paper sheets P overlying the lowermost paper sheet P away from the latter. Transporting means 38 refeeds the paper sheets P out of the refeed tray 32 to an image forming section which will be described with reference to FIG. 3. Sucking means 40 urges the lowermost paper sheet on the tray 32 against the transporting means 38 by suction. Velocity switching means 42 controls the the velocity of air which the air knife 36 blows against the edge Pa of the paper sheets P in a direction A shown in FIG. 2. Specifically, the velocity switching means 42 maintains the air velocity at a breeze velocity which does not lift the paper sheets P, until the number of paper sheets P sequentially stacked on the tray 32 exceeds a predetermined number, e.g. ten (selectable within the range of five to fifteen). The air velocity switching means 42 also sets up the breeze velocity when the number of paper sheets P becomes less than a predetermined number such as ten due to refeed.

A transport roller 46*a* is disposed on a discharge path 44 in such a manner as to contact the upper surface of the paper sheet P being driven onto the tray 32 by the discharge rollers 34. A feed roller 50 is located above the tray 32 and rotatable as indicated by an arrow D in FIG. 2. While the transport roller 46*a* is rotated, it rotates the feed roller 50 to cause the paper sheet P into abutment against an end fence 48. The feed roller 50 is partly protruded downward through a paper guide 52 which is also located above the tray 32. The end fence 48 has a horizontal extension 48*a* which is located above and spaced apart from the tray 32 by a predetermined distance and extends substantially in parallel to the tray 32. A rear end guide 54 is rotatably supported by a left end portion of the extension 48*a* of the end fence 48 and movable together with the end fence in a direction E. The rear end guide 54 may be implemented by a rod made of stainless steel and slightly bent at its intermediate portion in the form of a letter V. The left end of the rear end guide 54 is rotatably connected to a support portion formed in the extension 48*a* of the end fence 48. The rear end guide 54 having such a configuration is provided at two positions which are spaced apart in a direction perpendicular to a paper discharge direction F, i.e. in the widthwise direction of the paper sheets P. The two rear end guides 54 rest on the paper stack P adjacent to opposite sides of the latter by gravity.

Separating and transporting means 58 is located at the downstream side of the transporting means 38 for separating one of the paper sheets P being driven by the transporting means 38 out of the tray 32 from the others. The separating and transporting means 58 comprises a reverse roller 60 and a feed roller 62 which press against each other in the up-and-down direction (see FIG. 5 also). A reverse rotation shaft, not shown, constantly rotates in a direction G and constantly applies its force to the reverse roller 60 via a conventional torque limiter 64. When only one paper sheet P is refed from the tray 32 in a direction H, the reverse roller 60 is simply rotated in the opposite direction to the direction G by the feed roller 62 which is rotatable in a direction I. When two or more paper sheets P are driven out of the tray 32 together, the reverse roller 60 is reversed to rotate in the direction G to thereby return the paper sheet P overlying the lowermost one toward the tray 32. The reverse roller 60 is positioned at substantially the intermediate between opposite ends of the paper sheets P on the tray 32 with respect to the width of the paper sheets P. A roller 66 is affixed to a shaft 68 at the left-hand side of the transporting means 38. The feed roller 62 is also mounted on the shaft 68 through a one-way clutch, not shown, at substantially the intermediate between opposite ends of the shaft 68 to cooperate with the reverse roller 60.

A transmission type photosensor or similar sensor 70 senses the paper sheets P which are sequentially refed from the tray 32 in the direction H. A selector in the form of a pawl 72 selects either one of the discharge path 44 and a path 74 along which the paper sheet P coming into the device 30 from a fixing unit, which will be described, may travel. The transport path 74 guides the paper sheet P toward the refeed tray 32 in a two-sided copy mode. In the position shown in FIG. 2, the selector 72 selects the discharge path 44 so that the paper sheet P is transported by roller pairs 76*a* and 76*b* and 46*a* and 46*b* from the right to the left as viewed in FIG. 2.

As shown in FIG. 3, a copier 80 to which the paper refeeding device 30 is applied is shown and generally constituted by a copier body 82 and an ADF (Automatic Document Feeder) 84. The paper refeeding device 30 is located in an upper right portion of the copier body 82. The copier body 82 includes an operation board, not shown, which is accessible for entering desired copying conditions and has a print button. The copier 80 starts operating when desired copying conditions are set up on the operation board and the print button is pressed.

The ADF 84 has a document tray 86 for loading a stack of documents, and a belt for transporting a document as will be described. A document fed by the belt from the tray 86 is transported along a path 88 toward a glass platen 90. After the document has reached the glass platen 90, a flash lamp 92 is energized at a predetermined timing so as to illuminate the entire surface of the document at a time. The flash lamp 92 is energized by a power source 94 which has a capacitor for storing a charge. A reflection from the document is routed through a first mirror 96, a through lens 98 and a second mirror 100 to a photoconductive element 102 which is implemented as a belt. At this instant, the belt 102 has been uniformly charged by a main charger 104. Hence, the reflection from the document electrostatically forms a latent image representative of the document on the belt 102. After an eraser 106 has dissipated the charge from unnecessary portions of the belt 102, a developing unit 108 develops the latent image. The developed image is transferred to a paper sheet P by a transfer charger 110 at an image transfer station.

The paper sheet P is fed from either one of paper trays 112, 114 and 116 and paper refeeding device 30. The paper trays 112, 114 and 116 each has a separation roller. Sensors 118, 120 and 122 are located next to the separation rollers of the paper trays 112, 114 and 116, respectively. The paper sheet P fed from any one of the paper trays 112, 114 and 116 is transported along a path 124. A register roller 126 drives the paper sheet P toward the image transfer station in synchronism with the image formed on the belt 102. A transport belt 128 transports the paper sheet P carrying the image thereon to a fixing unit 130 to fix the image. When a two-sided copy mode is selected (or in a combination copy mode if available), the paper sheet P coming out of the fixing unit 130 is guided by a selector or pawl 132 into the refeed tray 32 of the device 30. When an ordinary one-sided copy mode is selected, the paper sheet is driven out to a copy tray 134. If a sorter is associated with the copier 80, the paper sheet P will be routed to an outlet 136. On the other hand, after the document has been illuminated, it is driven by the transport belt 138 away from the glass platen 90 and then returned to the tray 86 by a discharge roller 140.

Figure 4:
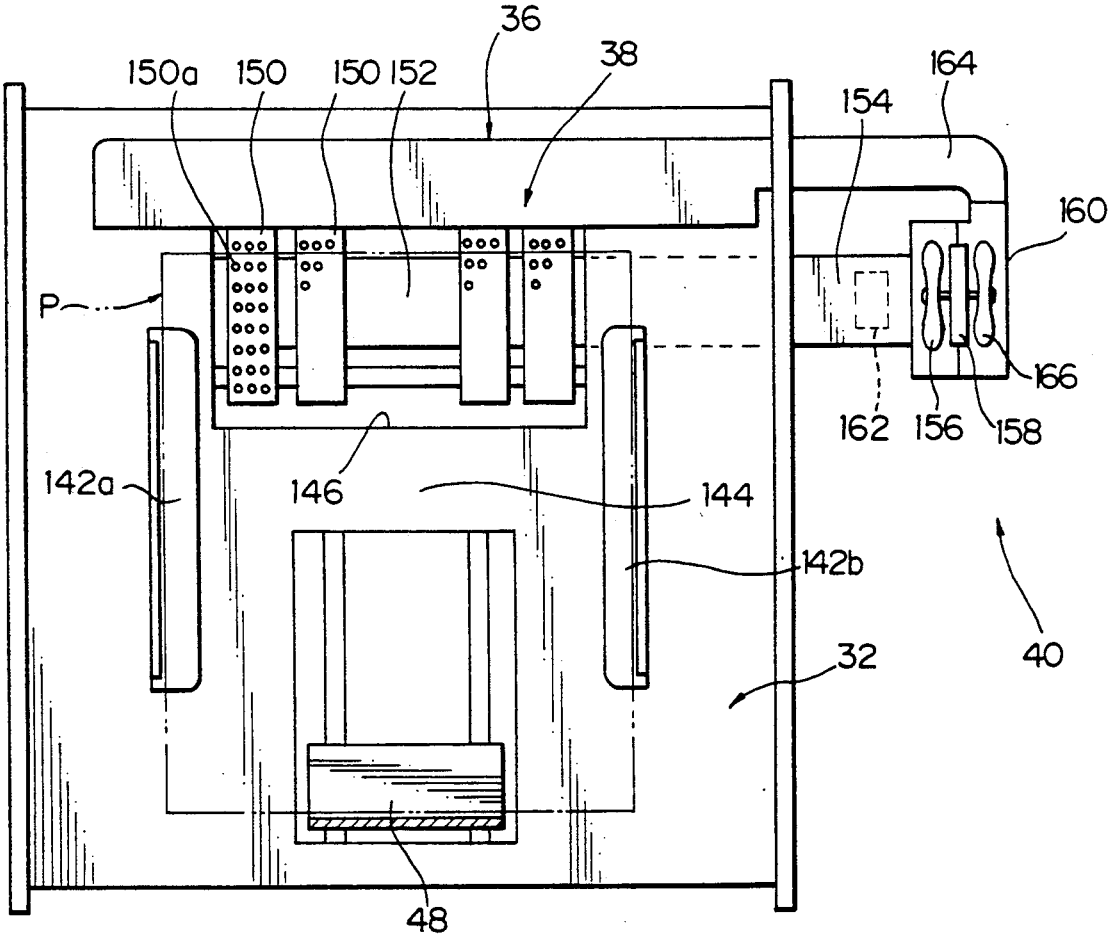
FIGS. 4 and 5 are respectively a plan view and a side elevation showing a refeed tray and various components associated therewith.
Figure 5:
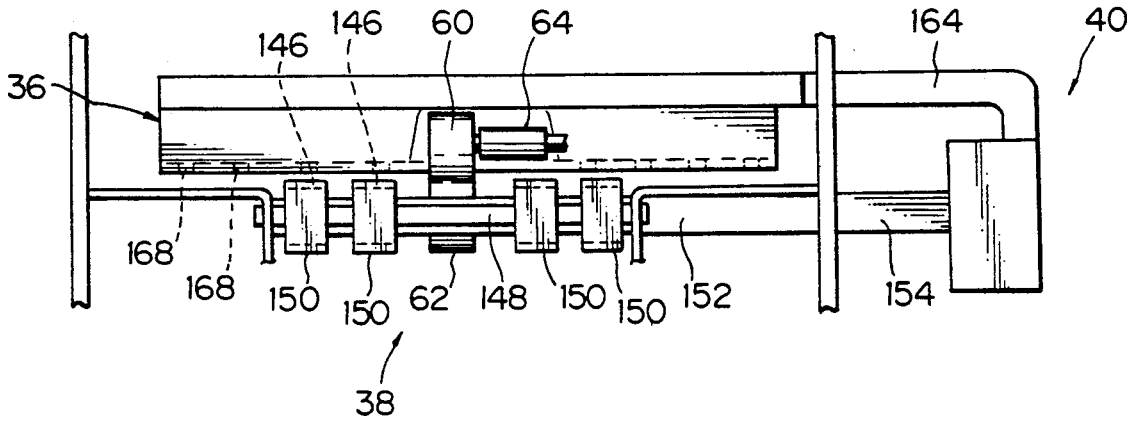

A reference will also be made to FIGS. 4 and 5 for describing the refeed tray 32 and its associated components in detail.

As shown in FIG. 4, the refeed tray 32 has a pair of side fences 142*a* and 142*b* which cooperate with the end fence 48 to define a stacking section 144. The paper sheet P entering the refeed tray 32 via the discharge rollers 34, FIG. 2, is guided by the side fences 142*a* and 142*b* and end fence 48 until it has been positioned at a predetermined position in the stacking section 144 which is adequate for refeed. The transporting means 38 is located in a large opening 146 which is formed through the stacking section 144 at the opposite side the end face 48.

As shown in FIG. 5, the transporting means 38 has a plurality of spaced rollers, four in the illustrative embodiment, 146 which are mounted on a shaft 148. A plurality of spaced rollers, also four rollers in the illustrative embodiment, 66 (see FIG. 2) are mounted on the shaft 66. Four endless belts 150 each is passed over associated ones of the rollers 66 and 146. As FIG. 4 indicates, the endless belts 150 are individually formed with a number of apertures 150*a*. A vacuum tank 152 is disposed between opposite runs of the belts 150. As shown in FIG. 2, the upper surface 150*b* of each belt 150 which serves as a transport surface is substantially flush with the upper surface (stacking surface) of the refeed tray 32. The upper wall of the vacuum tank 152 is formed with a number of apertures 152*a* in positions corresponding to the belts 150. As shown in FIG. 4, a fan 156 is connected to the vacuum tank 152 by a duct 154. When the fan 156 is driven, a sucking force is developed in the vacuum tank 152 to urge the lowermost paper sheet P loaded on the stacking section 144 against the belts 150. The fan 156 is mounted on one end of an output shaft of a motor 158 and accommodated in a casing 160. When the motor 158 is rotated to drive the fan 156, the fan 156 generates a sucking force in the vacuum tank 152 as indicated by an arrow J in FIG. 2.

In FIG. 4, the reference numeral 162 designates a valve which allows the sucking means 40 to exert the suction at a predetermined timing. In the illustrative embodiment, the vacuum tank 152, duct 154, fan 156, casing 160 and motor 158 constitute the sucking means 40 for urging the lowermost paper sheet against the refeed tray 32 by suction.

As shown in FIG. 4, the air knife 36 is located in front of (above) the refeed tray 32 and communicated to an air quantity switching section 164. An exclusive fan 166 for the air knife 36 is mounted on the output shaft of the motor 158 at the opposite side to the vacuum fan 156. The fan 166 blows air into the air quantity switching section 164. As shown in FIG. 2, an air outlet 168 is positioned in the vicinity of the end Pa of the paper stack P which will be the leading end at a refeeding stage. The air outlet 168 is oriented obliquely downward. Compressed air from the fan 166 is blown through the outlet 168 to between the paper sheets P and the upper surface of the tray 32, whereby the paper sheets overlying the lowermost paper sheet are lifted away from the latter which is pressed against the endless belts 150 by the sucking means 40.

Figure 6:
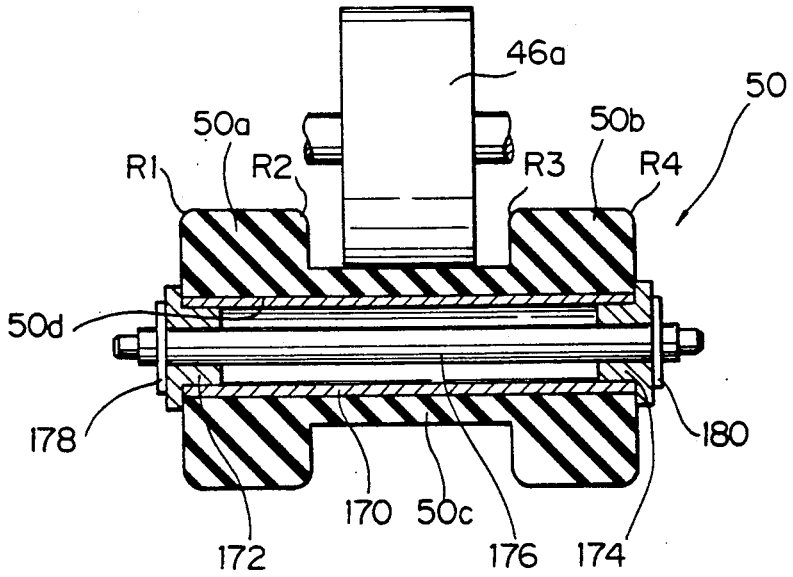
FIG. 6 is a vertical section showing a feed roller in detail.

Referring to FIG. 6, the configuration of the feed roller 50 is shown in detail. As shown, the feed roller 50 has roller portions 50*a* and 50*b* at opposite ends thereof. The roller portions 50*a* and 50*b* are interconnected by a shank portion 50*c* which is smaller in diameter than the former. A bore 50*d* extends axially throughout the feed roller 50. A hollow tube 170 is received in the bore 50*d* and rigidly connected to the wall of the bore 50*d* by adhesive. Bearings 172 and 174 are fitted in opposite ends of the hollow tube 170, while a shaft 176 is supported at opposite ends thereof by the bearings 172 and 174. E-rings 178 and 180 are fitted on opposite ends of the shaft 176. By such a structure, the feed roller 50 is rotatably supported. As shown in FIG. 2, the opposite ends of the shaft 176 are received in slots 182*a* of a bracket 182 which is affixed to a stationary part of the device 30, so that the shaft 176 is movable up and down. A leaf spring 184 constantly biases the shaft 176 toward the transport roller 46*a* to urge the shank portion 50*c* of the feed roller 50 against the transport roller 46*a*. In this configuration, the feed roller 50 is rotatable in the direction D by being driven by the transport roller 46*a*.

The feed roller 50 may advantageously be made of rubber such as foam chloroprene rubber or EPDM. As shown in FIG. 6, the corners $R_1$ to $R_4$ of the roller portions 50*a* and 50*b* are rounded so as not to scratch the paper sheets P. The feed roller 50 is operable at a transport speed (linear velocity) slightly higher than the transport speed of the discharge roller 34.

Figure 7:
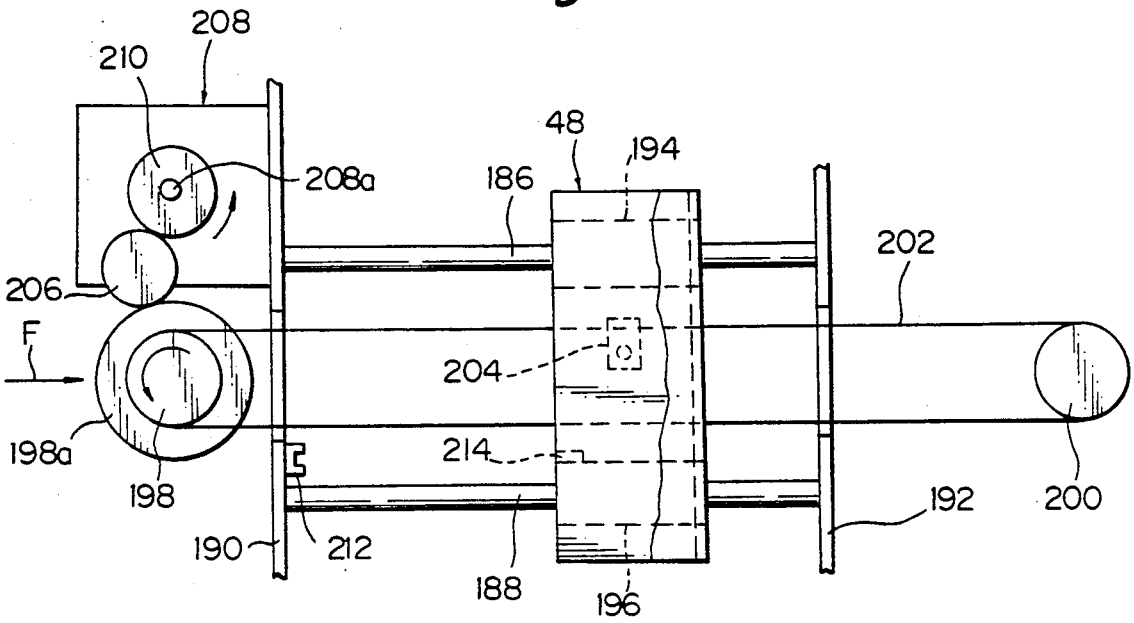
FIG. 7 is a plan view showing a mechanism for shifting an end fence in an intended direction of paper discharge.

FIG. 7 depicts a mechanism for shifting the end fence 48 in the intended direction of paper discharge F. The mechanism includes two guide rods 186 and 188 which extend in parallel to each other and are spaced apart from each other by a predetermined distance. Opposite ends of the guide rods 186 and 188 are rigidly retained by support plates 190 and 192. As best shown in FIG. 2, guide blocks 194 and 196 are affixed to the underside of the end fence 48. The guide rods 186 and 188 extend throughout the guide blocks 194 and 196, respectively. The end fence 48 is, therefore, selectively movable along the guide rods 186 and 188 through its guide blocks 194 and 196 in the direction F and the opposite direction to the direction F. Pulleys 198 and 200 are located at spaced positions at the right-hand side and left-hand side of the end fence 48 and on an imaginary line which extends through substantially the intermediate portion of the end fence 48. A timing belt 202 is passed over the pulleys 198 and 200. The timing belt 202 is affixed at one portion thereof to the underside of the end fence 48 by a metallic fixture 204. A gear 198*a* is provided integrally with the pulley 198 which is a drive pulley. A drive gear 210 is rigidly mounted on an output shaft 208*a* of a stepping motor 208 and held in mesh with an idle gear 206 which is meshed with the gear 198*a*. As the stepping motor 208 is rotated in either one of opposite directions by a particular number of pulses matching the paper size, the end fence 48 is shifted in the left-and-right direction as viewed in FIG. 7 to an optimal position matching the paper size. A transmission type photosensor or similar home position sensor 212 senses a piece 214 fitted on the underside of the end fence 48 when the end fence 48 is in its home position (left-hand side in FIG. 7).

A reference will be made to FIG. 8 for describing a mechanism for switching the air velocity of the air knife 36 to the breeze velocity which does not lift the paper sheets P as stated earlier.

Figure 8:
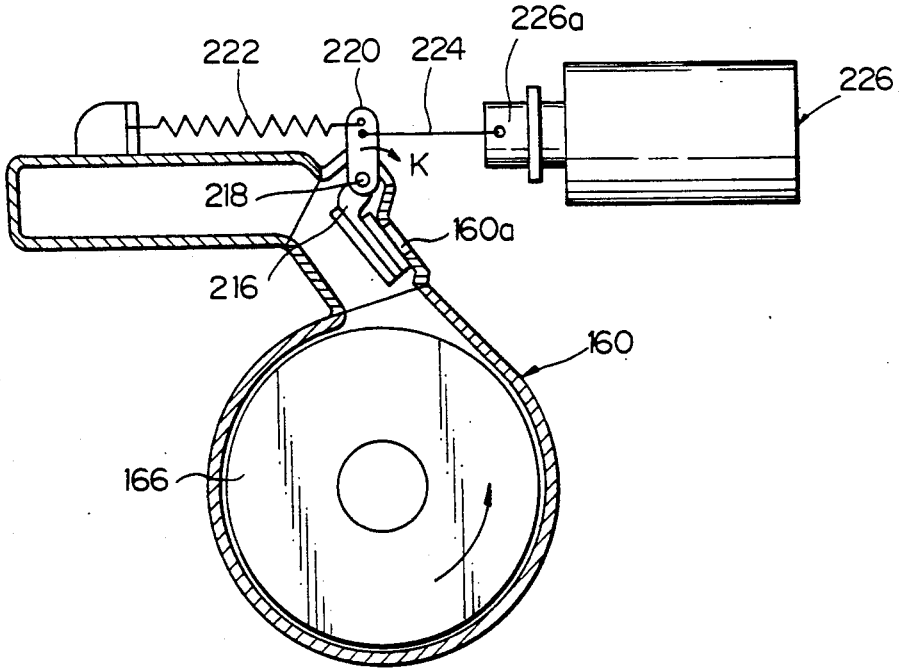
FIG. 8 is a vertical section showing a mechanism for switching over the air velocity of an air knife to a breeze velocity which does not lift paper sheets.

As shown in FIG. 8, the air knife fan 166 is accommodated in a casing 160 which has an opening 160*a*. A closure member, or shutter, 216 is rotatably supported by a shaft 218 within the casing 160 so as to selectively open and close the opening 160*a*. A lever 220 is affixed to one end of the shutter 216, while a spring 222 is anchored to one end of the lever 220 to constantly bias the lever 220 in a direction for causing the shutter 216 to close the opening 160*a*. A drive rod 224 is connected at one end to the lever 220 and at the other end to a plunger 226*a* of a solenoid 226 such that it acts against the force of the spring 222. A cushioning member is adhered to each of opposite faces of the shutter 216 in order to insure air-tightness. The lever 220 is rotatable about the shaft 218 while a portion thereof extending throughout the casing 160 is prevented from effecting air-tightness by an elastic member such as rubber fitted on the casing 160.

Figure 9:
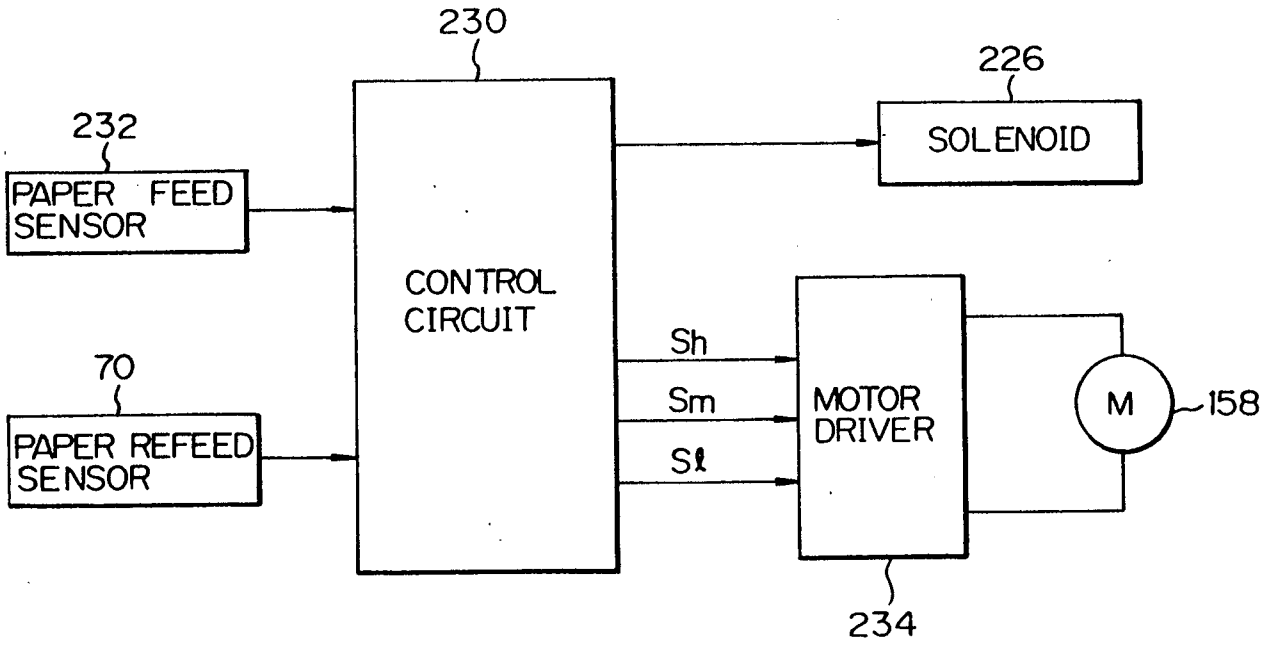
FIG. 9 is a schematic block diagram showing a control unit and components assiciated therewith which cooperate to control the air velocity of the air knife to the breeze velocity before more than ten paper sheets are stacked on the refeed tray and when the number of paper sheets remaining on the refeed tray at a refeeding stage decreases to ten.

FIG. 9 schematically shows a control unit 230 and its associated components which cooperate to maintain the stream of air from the air knife 36 at the breeze velocity before the number of paper sheets stacked on the refeed tray 32 exceeds ten and when it decreases to ten at a refeeding stage, as stated earlier. The control unit 230 has a microcomputer made up of a CPU (Central Processing Unit) having various kinds of deciding and processing functions, a ROM or program memory loaded with a program and fixed data indispensable in switching over the air velocity of the air knife 36, a RAM or data memory loaded with processing data, and an input/output (I/O) circuit. The control unit 230 further includes an analog-to-digital (AD) converter, driver, and counter. A sensor 232 produces a paper detection signal every time it senses a paper sheet P which may be fed from any one of the paper trays 112, 114 and 116. The sensor 70 produces a refeed detection signal every time it senses a paper sheet P refed from the refeed tray 32. These outputs of the sensors 232 and 70 are fed to the control unit 230. In response, the control unit 230 sends a solenoid drive signal to the solenoid 226 while sending motor drive signals Sl, Sm and Sh to a motor driver 234. The motor driver 234 drives the motor 158 at a high speed, a medium speed and a low speed in response to the motor drive signals Sl, Sm and Sh, respectively. This motor speed control may be effected by controlling the current which flows through the motor 158.

In the illustrative embodiment, the control unit 230, solenoid 226, casing 160 having the opening 160*a*, and shutter 216 associated with the opening 160*a* constitute the velocity switching means 42 which has the above-stated function.

The paper refeeding device 30 having the above construction will be operated as follows.

Assume that the refeed tray 32 of the device 30 is capable of accommodating 100 paper sheets in a stack, that the motor 158 is operated at the low speed when the number of stacked paper sheets is less than forty, at the medium speed when it is forty to sixty-nine, and at the high speed when it is seventy or more, and that 100 two-sided copies are desired. Then, the operator manipulates the operation board of the copier body 82, FIG. 3, to select a two-sided copy mode, enters "100" which is the desired number of copies, and then presses the print button. In response, paper sheets P are sequentially fed from one of the paper trays 112, 114 and 116 which is loaded with paper sheets of desired size. Assuming that the paper tray 114 is selected, the associated sensor 120 immediately senses the successive paper sheets P coming out of the paper tray 114. The control unit 230 starts counting the paper sheets P in terms of the paper detection outputs of the sensor 120, and it continuously feeds the solenoid drive signal to the solenoid 226 until the count reaches "10". In this condition, the lever 220, FIG. 8, is rotated in a direction indicated by an arrow K to unblock the opening 160*a*, whereby most of the air existing in the casing 160 is released to the outside. As a result, air is blown at the breeze velocity through the outlet 168 of the air knife 36, FIG. 2, in the direction A. From the count "11" to the count "39", the control unit 230 continuously feeds the motor drive signal Sl to the motor driver 234 which then drives the motor 158 at the low speed. Hence, air is blown out from the air knife 36 at the low velocity by the fan 166. As the count reaches "40", the control unit 230 delivers the motor drive signal Sm to the motor driver 234 so as to switch over the air velocity to the medium velocity. On the increase of the count to "70", the control unit 230 sends the motor drive signal Sh to replace the medium velocity with the high velocity.

The control unit 230 receives a paper detection signal from the sensor 118 substantially at the same time as the sensor 118 senses a paper sheet P. However, since a certain period of time is necessary for the paper sheet to reach the refeed tray 32, the control unit 230 is constructed to deliver the motor drive signals Sl, Sm and Sh to the motor driver 234 at the time when the sensed paper sheet P will have been stacked on the tray 32.

As stated above, while the paper sheets P are successively stacked on the refeed tray 32, the velocity of air being blown through the outlet of the air knife 36 against the end Pa of the paper sheets P is switched over in matching relation to the number of paper sheets P. After 100 one-sided copies each carrying an image on one side thereof have been produced and stacked on the tray 32, the refeeding device 30 starts refeeding them from the tray 32. Specifically, air is blown out by the air knife 36 at the high velocity against the end Pa of the paper sheets P. At the same time, the motor 158, FIG. 4, drives the fan 156 at a high speed to generate a sucking force which acts in a direction J as shown in FIG. 2. The sucking force urges the lowermost paper sheet P on the tray 32 against the upper surfaces 150*b* of the endless belts 150, while the other paper sheets overlying the lowermost one are lifted. In this condition, the rollers 66 are driven at a predetermined feed timing in the direction I to in turn cause the associated belts 150 to drive only the lowermost paper sheet P to the left. The feed roller 62 drives the paper sheet P further to the transport path 124, FIG. 3.

The above procedure is repeated to refeed the stack of paper sheets P from the refeed tray 32, the lowermost one being first. Every time a paper sheet P is refed from the tray 32, the sensor 70 senses it and delivers a refeed detection signal to the control unit 230. As the number of refed paper sheets P reaches "31" as counted by the control unit 230, i.e., as the number of paper sheets P left on the tray 32 decreases to sixty-nine, the control unit 230 delivers the motor drive signal Sm to the motor driver 234 in the same manner as at the stacking stage. This lowers the air velocity to the medium velocity. As the count further increases to "61", meaning that thirty-nine paper sheets P are left on the tray 32, the control unit 230 delivers the motor drive signal Sl to further lower the air velocity to the low velocity. When the count reaches "90", meaning that only ten paper sheets P are left on the tray 32, the control unit 230 feeds the solenoid drive signal to the solenoid 226. In response, the solenoid 226 actuates the lever 220 as indicated by an arrow K in FIG. 8, whereby the opening 160*a* is unblocked. As a result, most of the air existing in the casing 160 is released to control the air being blown out from the air knife 36 to the breeze velocity. At this instant, the motor 158 is rotating at the low speed. Therefore, the suction being developed by the vacuum fan 156 is intense enough to urge the lowermost paper sheet on the refeed tray 32 against the endless belts 150. This allows the lowermost paper sheet to be refed by the belts 150 in the direction H, FIG. 2, while being urged against the latter. Although such a small number of paper sheets are not lifted and, therefore, apt to move out together, the reverse roller 60 rotates in the direction G to return the paper sheets toward the tray 32, the uppermost paper sheet being first, and thereby separates the lowermost sheet from the others.

Figure 10:
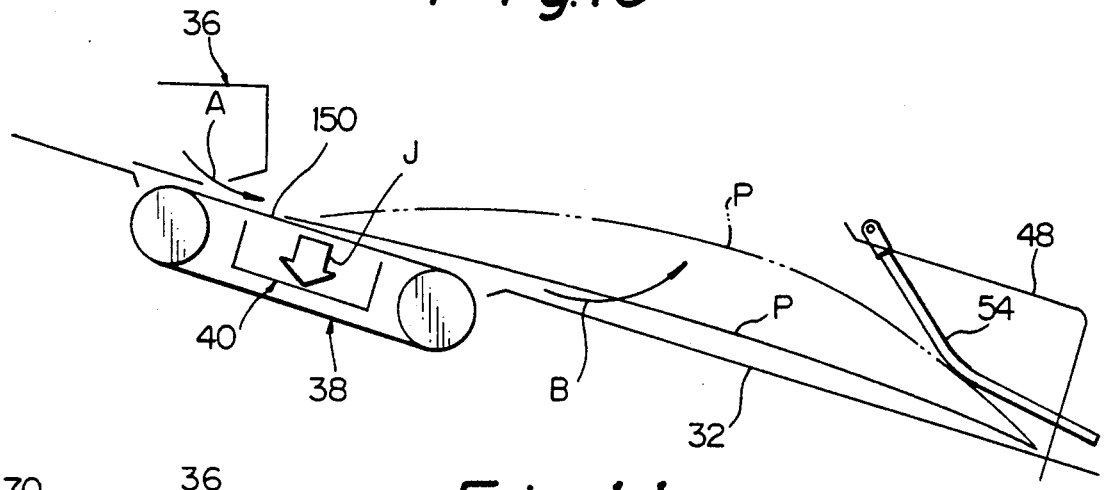
FIGS. 10 and 11 are schematic views demonstrating an undesirable occurrence ascriable to the switchover of the air velocity to a low velocity at a stacking stage.
Figure 11:
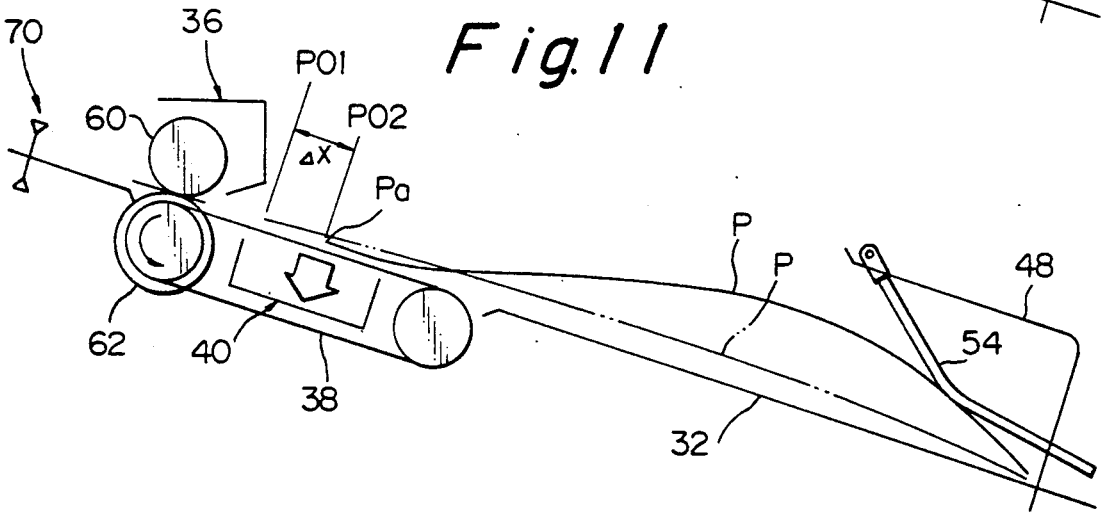

In the illustrative embodiment, before more than ten paper sheets P are sequentially stacked on the refeed tray 32, the air being blown against the end Pa of the paper sheets P, FIG. 2, is maintained at the breeze velocity, as stated previously. Hence, even when ten or less paper sheets are stacked on the tray 32 and curled, as shown in FIG. 10, they can be surely refed. Specifically, assume that a paper sheet P is stacked on the tray 32 and curled as indicated by a solid line in FIG. 10. Then, when air is blown at the low velocity (sufficient to lift paper sheets) in the direction A by the air knife 36, it reaches the underside of the paper sheet P to urge the latter upward in the direction B. This causes the paper sheet P to further curl to a position indicated by a phantom line in the figure, although the degree may depend on the elasticity and the degree of the curl of the paper sheet. As shown in FIG. 11, when refeed is started under such a condition, the paper sheet P sucked against the belts 150 of the transporting means 38 by the sucking means (in a direction J) has its edge (leading edge) Pa located at a position $PO_2$ deviated by $\Delta x$ to the right, or upstream side at the stacking stage, from an expected position $PO_1$ where the edge Pa would be located if the curl were not aggravated.

For the above reason, even if the air from the air knife 36 is controlled to the breeze velocity with the suction being exerted, the refeed of the paper sheet P begins at the position $PO_2$. Hence, the sensor 70 senses the paper sheet P at a time later than the expected time by:

$$\frac{\Delta X}{V \text{ (linear velocity of transporting means 38)}} \text{ sec}$$

Therefore, in the case that the program determines that a paper sheet was not fed when the sensor 70 does not senses a paper sheet within a predetermined period of time after the start of refeed by the transporting means 38, the paper sheet P will be determined to have not been fed. Further, when the transporting means 38 is rotated over a predetermined period of time in the direction I to transport the paper sheet P by a predetermined amount to the left, the leading edge Pa of the paper sheet P will go over the nipping portion of the feed roller 62 and reverse roller 60, but it will stop at a position short of the sensor 70. Then, the sensor 70 will fail to sense the paper sheet P.

Figure 12:
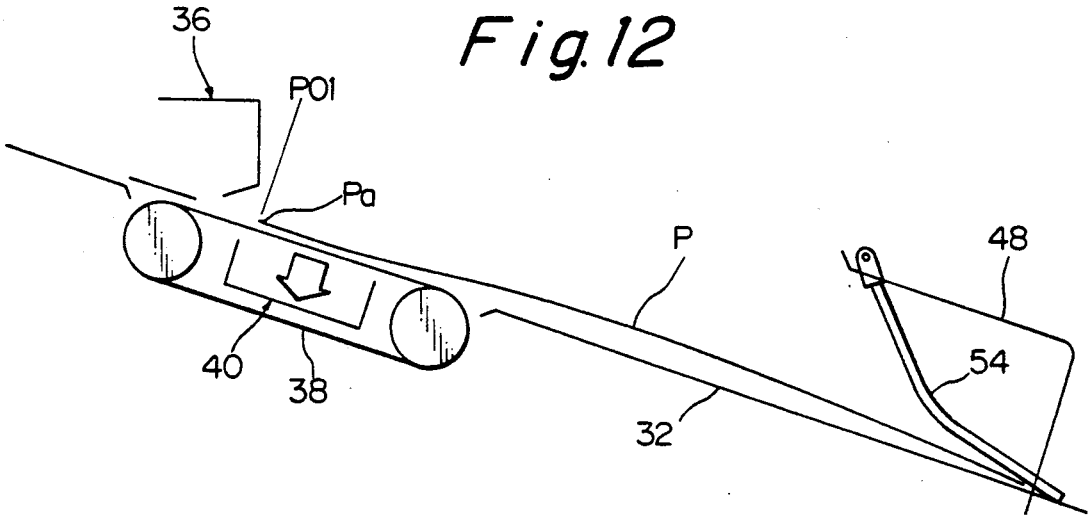
FIG. 12 is a view similar to FIGS. 10 and 11, indicating non-feed at a stacking stage which will be eliminated when the air velocity is switched over to the breeze velocity.

In the illustrative embodiment, even at the stacking stage, the stream of air generated by the air knife 36 is maintained at the breeze velocity which does not lift the paper sheet, until more than 10 paper sheets P have been stacked on the refeed tray 32. Such a light air stream is prevented from aggravating the curl of the paper sheet P, as shown in FIG. 12. Hence, the leading edge Pa of the paper sheet P is hardly deviated from the expected position $PO_1$ despite the suction exerted by the sucking means 40.

Figure 13:
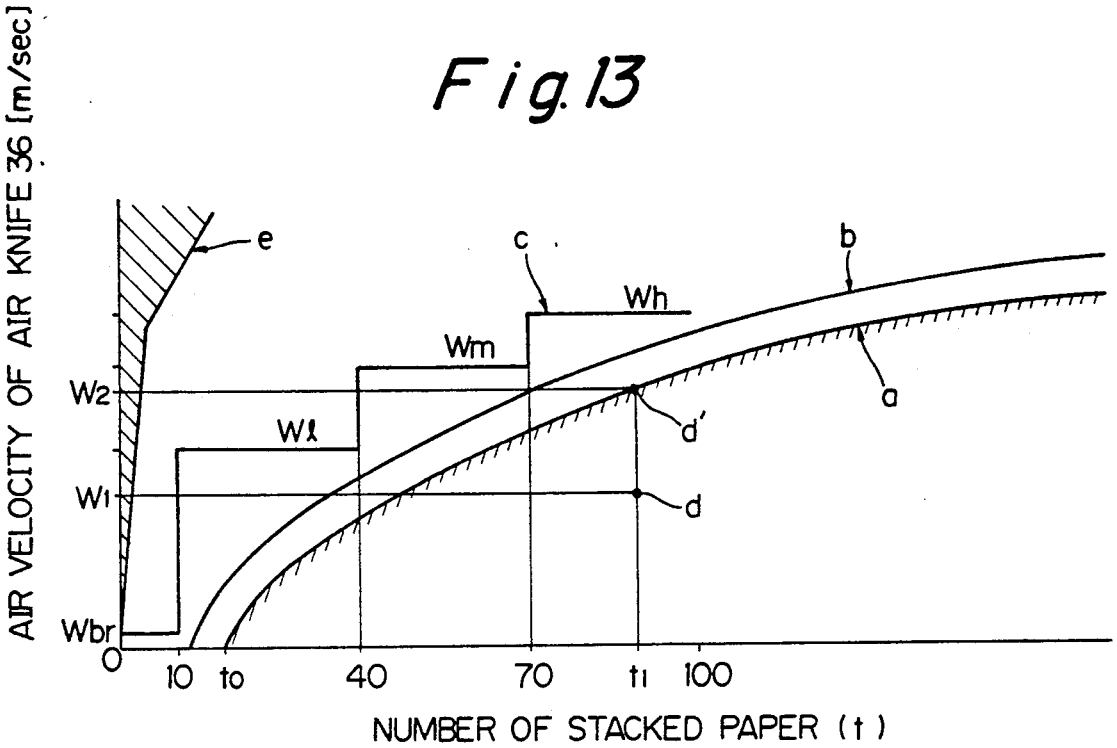
FIG. 13 is a graph showing a relationship between the number of stacked paper sheets and the air velocity of the air knife with respect to feed errors.

Referring to FIG. 13, there is shown a graph representative of a relationship between the number t of paper sheets stacked and the velocity W (m/sec) of the air knife 36 with respect to feed errors such as multiple feed and non-feed. In the figure, a curve a indicates a border line between a range wherein the feed errors occur (below the curve a) and a range wherein they do not occur. Assuming a point d, for example, the number of paper sheets is $t_1$ and the velocity of air stream is $W_1$, of course resulting in the feed errors. Therefore, when the number of paper sheets is $t_1$, the feed errors have to be eliminated by increasing the velocity of air stream above $W_2$ at a point d' where it meets the curve a. When the degree of a curl of a paper sheet and the elasticity of a paper sheet are taken into account, the curve or border line a should be replaced with a curve b.

Ideally, the relationship between the number of paper sheets t and the velocity W of air stream should be smoothly varied without steps, as represented by the curve b. However, such a stepless variation is not easy to achieve. The illustrative embodiment varies the above relationship stepwise, as indicated by a line c in FIG. 13. Specifically, the air velocity is switched to a breeze velocity Wbr when the number of sheets t is not more than ten, to a low velocity Wl when it is eleven to thirty-nine, to a medium velocity Wm when it is forty to sixty-nine, and to a high velocity Wh when is more than sixty-nine. At the stacking stage, the velocity W of the air knife 36 is changed stepwise as breeze velocity Wbr, low velocity Wl, medium veloity Wm and high velocity Wh in this order, and it is changed in the opposite order at the refeeding stage, as stated earlier. In FIG. 13, a line e is indicative of a range wherein the paper stack on the tray 32 bodily waves due to the air stream from the air knife 36 (left-hand side of the line e). Further, FIG. 13 indicates that paper feed can be fed without any feed error up to $t_0$ paper sheets even when the velocity W is 0 m/sec. This is derived from the operation of the separating and transporting means 58.

Figure 14:
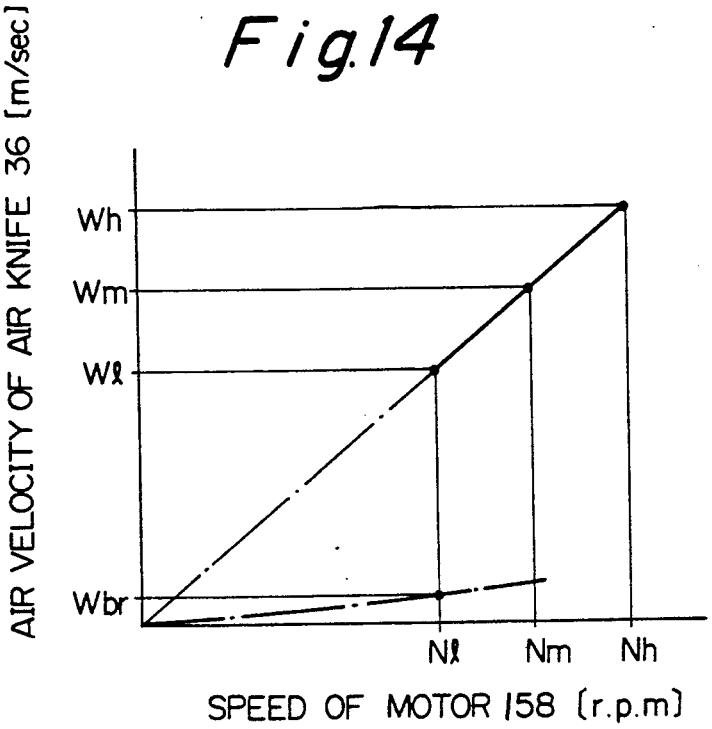
FIG. 14 is a graph showing a relationship between the rotation speed of a motor and the velocity of the air knife.

FIG. 14 shows a relationship between the rotation speed N (r.p.m) of the motor 158 and the air velocity W (m/sec) of the air knife 36. In the illustrative embodiment, despite that the air to be blown out from the air knife 36 and the suction for urging the lowermost paper sheet against the transporting means 38 are implemented by the same motor 158, the air velocity W is switched over to the breeze velocity Wbr by releasing air to the outside of the casing 160 through the opening 160*a*. Hence, as shown in FIG. 14, even when the air velocity is the breeze velocity Wbr, the motor 158 is maintained at a rotation speed Nl corresponding to the low velocity Wl. In this condition, a sucking force intense enough to urge the paper sheet against the transporting means 38 is exerted to thereby eliminate non-feed. In FIG. 14, Nm and Nh are representative of the rotation speeds of the motor 158 corresponding to the medium air velocity Wm and the high air velocity Wh, respectively.

A paper sheet P carrying an image on one side thereof and having been moved away from the fixing unit 130 is apt to curl backward, or toward the other side, at opposite ends thereof, as shown in FIG. 2. Assume that a paper sheet P' enters the refeeding device 30 after some paper sheets P have been sequentially stacked on the tray 32 in such a curled condition. Then, the curled paper stack P urges the incoming paper sheet P' against the paper guide 52 while the air being blown out from the air knife 36 lifts the paper sheet P' toward the paper guide 52. It is likely, therefore, that the paper sheet P' fails to reach a predetermined position or bends due to unsmooth discharge. This is apt to cause multiple feed or non-feed in the event of refeed.

As shown in FIG. 2, in the illustrative embodiment, the paper sheet P' driven into the device 30 by the discharge rollers 34 and guided by the underside of the paper guide 52 is transported by the feed roller 50 which is rotated in the direction D with a part thereof being protruded through the paper guide 52, until the paper sheet P' abuts against the end fence 48. Hence, the paper sheet P' is surely transported to and stacked at a predetermined position on the refeed tray 32.

The rear end guides 54 guide and urge toward the refeed tray 32 the edge Pb of the paper sheet P' which is driven out from the discharge rollers 34, the edge Pb being the trailing edge in the event of refeed. The edge Pb of the paper sheet P' is, therefore, free from rolling or similar occurrence ascribable to the curl and is surely stacked in the predetermined position. The end fence 48 is movable as indicated by the arrow E in FIG. 2. When a particular paper size is entered on the operation board of the copier body 82, the end fence 48 is automatically shifted to a particular position matching the entered paper size.

In the illustrative embodiment, the air stream from the air knife 36 is controlled to the breeze velocity when the number of paper sheets on the refeed tray 32 is ten or less, at both of the stacking stage and refeeding stage. This specific number is derived from the fact that non-feed is apt to occur especially when the number of stacked paper sheets is one to five, and some margin for safeness. A stack of ten or more paper sheets has a substantial weight and is, therefore, substantially prevented from being further curled by the air of the air knife 36 even when the air velocity is the low velocity.

The air velocity of the air knife 36 has been shown and described as being switched to the breeze velocity before more than ten paper sheets are stacked on the refeed tray 32 and when the number of sheets remaining on the tray 32 at the refeeding stage becomes less than ten. If desired, however, the air velocity at such stages may be reduced to zero or may be changed stage by stage.

The fans 166 and 156 assigned to the air knife or air blowing means 36 and the sucking means 40, respectively, may be driven by individual motors, if desired.

While the present invention has been shown and described in relation to a copier, it is of course applicable to any other image forming apparatus such as a printer.

In summary, in accordance with the present invention, even a small number of paper sheets which are curled or otherwise deformed can be stacked on a refeed tray and then surely refed. When the number of paper sheets remaining on the refeed tray in a refeeding stage becomes less than a predetermined number, they can be positively fed. Further, even if air blowing means (air knife) and sucking means are driven by single driving means, paper sheets can be surely refed at high speed. Thus, the present invention is successful in eliminating feed errors such as multiple feed and non-feed.

Various modifications will become possible for those skilled in the art after receiving the teachings of the present disclosure without departing from the scope thereof.

What is claimed is:

1. A paper refeeding device incorporated in an image forming apparatus for temporarily stacking paper sheets each coming out of an image forming section and carrying an image on one side on a refeed tray and, then, refeeding said paper sheets to said image forming section, said device comprising:

discharging means for discharging the paper sheets one by one onto the refeed tray by transporting said paper sheets;

air blowing means for blowing air at a low velocity, intermediate velocity and a high velocity against an end portion of the paper sheets discharged by said discharging means onto the refeed tray to lift the paper sheets overlying the lowermost paper sheet away from at least said lowermost paper sheet;

transporting means for refeeding the paper sheets stacked on the refeed tray to the image forming section;

sucking means for urging the lowermost paper sheet on the refeed tray against said transporting means by suction; and air velocity switching means for causing said air blowing means to blow air at a breeze velocity which is lower than said low velocity but greater than a zero velocity which does not lift the paper sheets, until more than a predetermined number of paper sheets have been discharged by said discharging means and stacked on the refeed tray.

2. A device as claimed in claim 1, further comprising single driving means for driving both of said air blowing means and said sucking means.

3. A device as claimed in claim 1, wherein said air velocity switching means also causes said air blowing means to blow air at either one of the breeze velocity and the zero velocity which do not lift the paper sheets, when the number of the paper sheets remaining on the refeed tray while said paper sheets are refed decreases to a predetermined number.

4. A device as claimed in claim 1, wherein said air velocity switching means comprises a casing having an opening for partially releasing the air blowing against the paper sheets to the outside so as to provide for said breeze velocity.

5. A device as claimed in claim 4, wherein said air velocity switching means further comprises a solenoid actuated shutter means for selectively opening and closing said opening.

6. A device as claimed in claim 2, wherein a sucking force of said sucking means increases as said air blowing velocity increases and decreases as said air blowing velocity decreases.

7. A paper refeeding device incorporated in an image forming apparatus for temporarily stacking paper sheets each coming out of an image forming section and carrying an image on one side on a refeed tray and, then, refeeding said paper sheets to said image forming section, said device comprising:

discharging means for discharging the paper sheets one by one onto the refeed tray by transporting said paper sheets;

air blowing means for blowing air against an end portion of the paper sheets discharged by said discharging means onto the refeed tray to lift the paper sheets overlying the lowermost paper sheet away from at least said lowermost paper sheet;

transporting means for refeeding the paper sheets stacked on the refeed tray to the image forming section;

sucking means for urging the lowermost paper sheet on the refeed tray against said transporting means by suction; and air velocity switching means for causing said air blowing means to blow air at either one of a breeze velocity and a zero velocity which do not lift the paper sheets, until more than a predetermined number of paper sheets have been discharged by said discharging means and stacked on the refeed tray, said air velocity switching means comprising a casing with an opening for partially releasing the air blowing against the paper sheets to the outside so as to provide for said breeze velocity.

8. A device according to claim 7, wherein said air velocity switching means further comprises a solenoid actuated shutter means for selectively opening and closing said opening.

9. A device according to claim 7, wherein a sucking force of said sucking means increases as said air blowing velocity increases and decreases as said air blowing velocity decreases.

* * * * *